US006647598B2

(12) United States Patent
Lin

(10) Patent No.: US 6,647,598 B2
(45) Date of Patent: Nov. 18, 2003

(54) NEEDLE LOCKING STRUCTURE OF A ZIPPER SLIDE

(76) Inventor: Yu-Pau Lin, No. 151, Kung Erh Road, Wu Lin Tsuen, Lung Tan Hsiang, Tao Yuan Hsien (TW)

( * ) Notice: Subject to any disclaimer, the term of this patent is extended or adjusted under 35 U.S.C. 154(b) by 0 days.

(21) Appl. No.: 10/108,489

(22) Filed: Mar. 29, 2002

(65) Prior Publication Data

US 2003/0182774 A1 Oct. 2, 2003

(51) Int. Cl.[7] ..... A44B 19/30
(52) U.S. Cl. ..... 24/420; 24/421; 24/436
(58) Field of Search ..... 24/420, 421, 418, 24/424, 425

(56) References Cited

U.S. PATENT DOCUMENTS 2,989,792 A * 6/1961 Hueister ..... 24/421
3,287,780 A * 11/1966 Cooperberg ..... 24/421
4,069,556 A * 1/1978 Takahashi ..... 24/421
4,422,220 A * 12/1983 Oda ..... 24/421
5,901,420 A * 5/1999 Oda ..... 24/420

* cited by examiner

*Primary Examiner*—Robert J. Sandy
(74) *Attorney, Agent, or Firm*—Rosenberg, Klein & Lee

(57) ABSTRACT

A needle locking structure of a zipper slide for engaging or disengaging two lengths of teeth on two opposite teeth tapes is provided. A monolithic main body has two joint portions formed thereon. An engagement part is formed on each side of the main body. A spring piece is fixed by the joint portions of the main body. A pull tab unit is fixed by the joint portions of the main body for facilitating the manipulation of pulling the zipper slide. A laterally shifted extending portion is provided at one end of the spring piece. Since the extension portion jabs the top of an engagement line of one of the teeth tapes, the friction force is increased whereby improving the positioning of the main body and preventing unwarily sliding of the zipper slide.

8 Claims, 6 Drawing Sheets

NEEDLE LOCKING STRUCTURE OF A ZIPPER SLIDE

BACKGROUND OF THE INVENTION

1. Field of the Invention

The present invention relates to the field of zipper slides, and more particularly to a zipper slide provided with means for restraining interlocking teeth thereof from disengaging when the slide has been moved with a coupled pull tab to a desired position on a zipper. The teeth on the zipper tape may be made from either metal or plastic materials.

2. Description of the Prior Art

FIG. 1 to FIG. 3 illustrate a typical needle locking mechanism for a zipper slide. As shown in FIG. 1, the needle locking mechanism generally includes a slide body 10 that is integrally made by metal or the like, a leaf spring piece 11, and a pull tab unit 12. On a top surface of the slide body 10 there are provided a first joint portion 101 and a second joint portion 102. The first joint portion 101 and the second joint portion 102 are used to buckle the leaf spring piece 11 and also the pull tab unit 12 in place. Engagement channel 104 is provided in a front end of the slide body 10. As shown in FIG. 2, the engagement channel 104 slides along the lengths of interlocking teeth 15 of the teeth tapes 13 and 14 to facilitate the engagement and disengagement thereof.

The leaf spring piece 11 buckles the pull tab unit 12 by passing through opening 121 of the pull tab unit 12. As illustrated, the leaf spring piece 11 has a hooked portion 111 in one end and a downwardly extending portion 112 formed in the other end. When assembling, the hooked portion 111 is inserted into the front end of the slide body 10, as shown in FIG. 2. The first joint portion 101 is then bent down so as to clip and fasten the leaf spring piece 11. The extending portion 112 is inserted into a slot 103 located on the rear of the slide body 10.

Still referring to FIG. 2, the pull tab unit 12 facilitates manipulation of sliding the slide body to engage or disengage the metal teeth 15 of opposite teeth tapes 13 and 14. The opening 121 is formed on the pull tab unit 12 and is designed to allow the passing of the leaf spring piece 11. One side of the opening 121 is a beam 123 with a recess portion 122 thereon. The beam 123 is coupled with the second joint portion 102 and is restrained by the leaf spring piece 11. The recess portion 122 is provided for positioning purpose for the leaf spring piece 11. Typically, the width of the recess portion 122 is substantially equivalent to the width of the leaf spring piece 11.

The horizontal level of the first joint portion 101 is lower than the level of the second joint portion 102. As shown in FIG. 3, when the pull tab unit 12 is pulled in an angle relative to the slide body 10, the beam 123 slightly rotates and the extending portion 112 of the leaf spring piece 11 is uplifted by the recess portion 122 to leave the slot 103. By this way, the slide body can smoothly slides along the two lengths of interlocking teeth to facilitate the engagement and disengagement. When one stop pulling the pull tab unit 12 the extending portion 112 is pushed back into the slot 103 to lock the teeth in place and thus preventing slipping of the slide body 10 and unwarily open of the zipper.

However, the above-mentioned prior art structure is only suited for metal teeth 15 that have smaller inter-space between two adjacent teeth. When the prior art structure is applied to two lengths of plastic teeth the extending portion 112 of the leaf spring piece usually malfunctions due to a larger inter-space between two adjacent teeth. As shown in FIG. 3, the extending portion 112 of the leaf spring piece 11 is too close to the front of the engagement line 131 at one side of the teeth tape 13. This deteriorates the functioning of the extending portion 112 to prevent slide body 10 from sliding down along the lengths of interlocking teeth. Consequently, there is a strong need to provide an improved needle locking mechanism for zipper slides.

SUMMARY OF THE INVENTION

Accordingly, it is a primary object of the present invention to provide an improved needle locking mechanism for zipper slides. The needle locking mechanism according to this invention is capable of engaging with either metal teeth or plastic teeth in a more tight-knit way.

According to the claimed invention, a needle locking structure of a zipper slide for engaging or disengaging two lengths of teeth on two opposite teeth tapes is provided. A monolithic main body has two joint portions formed thereon. An engagement part is formed on each side of the main body. A spring piece is fixed by the joint portions of the main body. A pull tab unit is fixed by the joint portions of the main body for facilitating the manipulation of pulling the zipper slide. A laterally shifted extending portion is provided at one end of the spring piece. Since the extension portion jabs the top of an engagement line of one of the teeth tapes, the friction force is increased whereby improving the positioning of the main body and preventing unwarily sliding of the zipper slide.

It is to be understood that both the forgoing general description and the following detailed description are exemplary, and are intended to provide further explanation of the invention as claimed. Other advantages and features of the invention will be apparent from the following description, drawings and claims.

DETAILED DESCRIPTION OF THE PREFERRED EMBODIMENT

Figure 1:
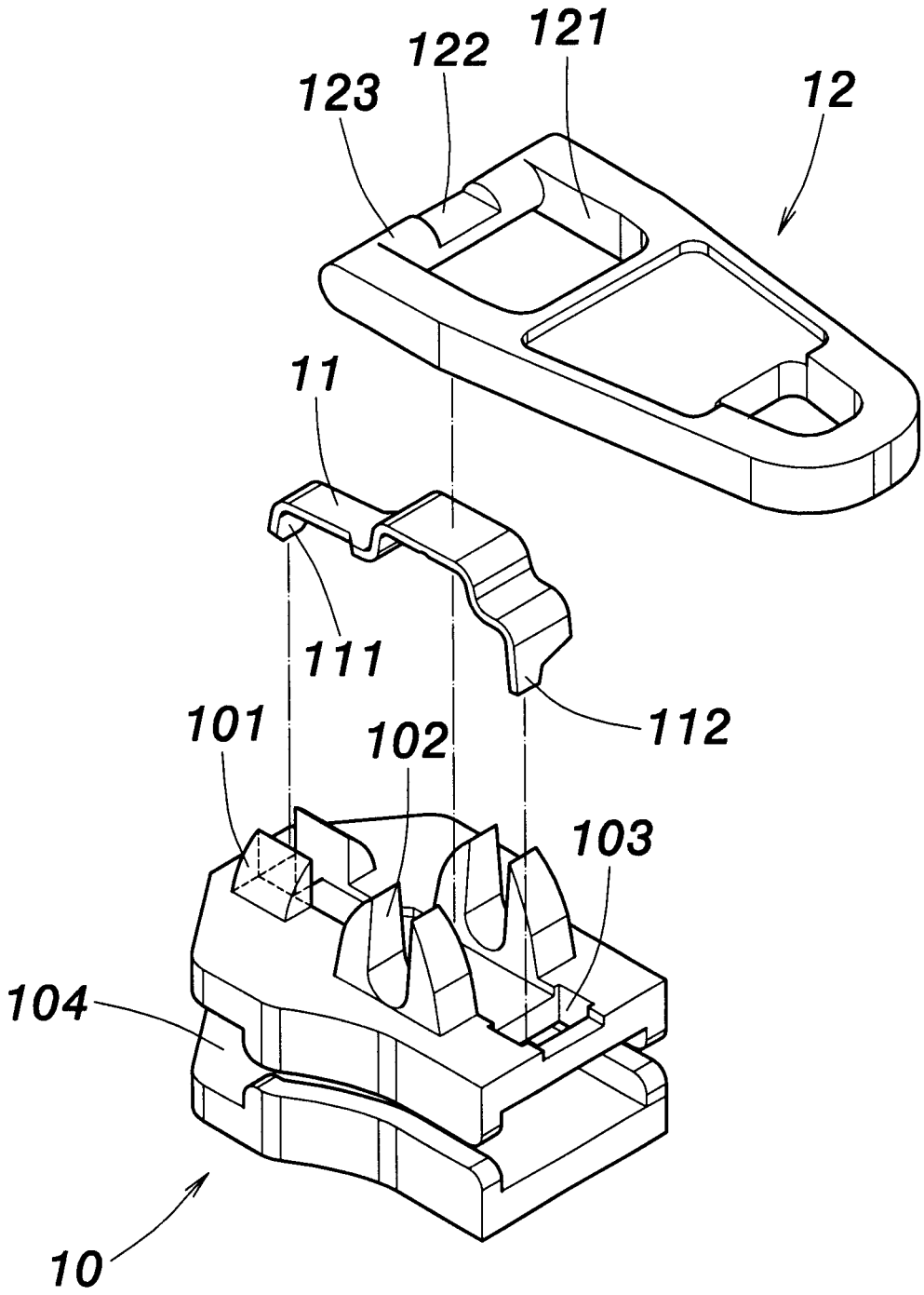
FIG. 1 PRIOR ART
FIG. 1 is a schematic diagram showing a prior art zipper slide.
Figure 2:
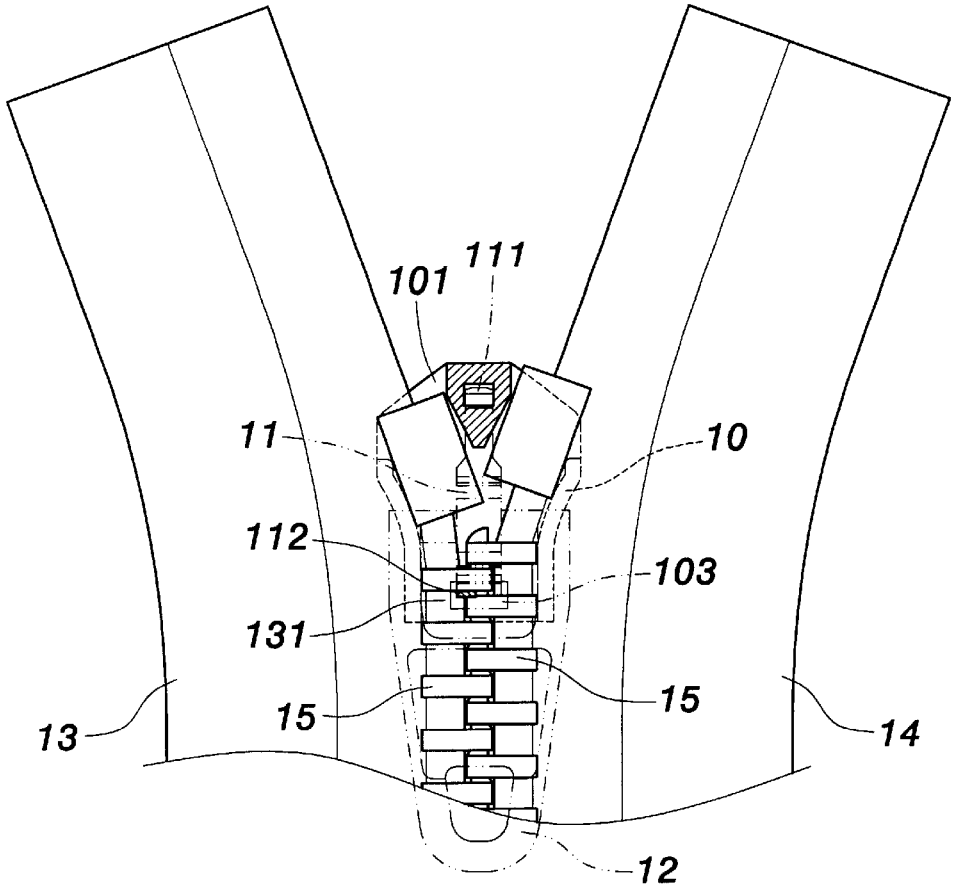
FIG. 2 PRIOR ART
FIG. 2 is a cross sectional diagram showing the prior art zipper slide of FIG. 1.
Figure 3:
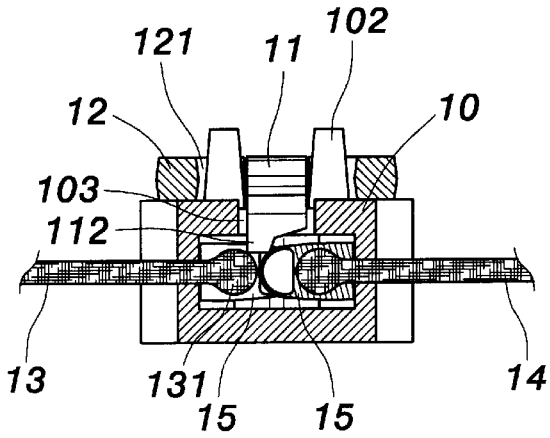
FIG. 3 PRIOR ART
FIG. 3 is a cross sectional diagram showing the prior art zipper slide of FIG. 1.
Figure 4:
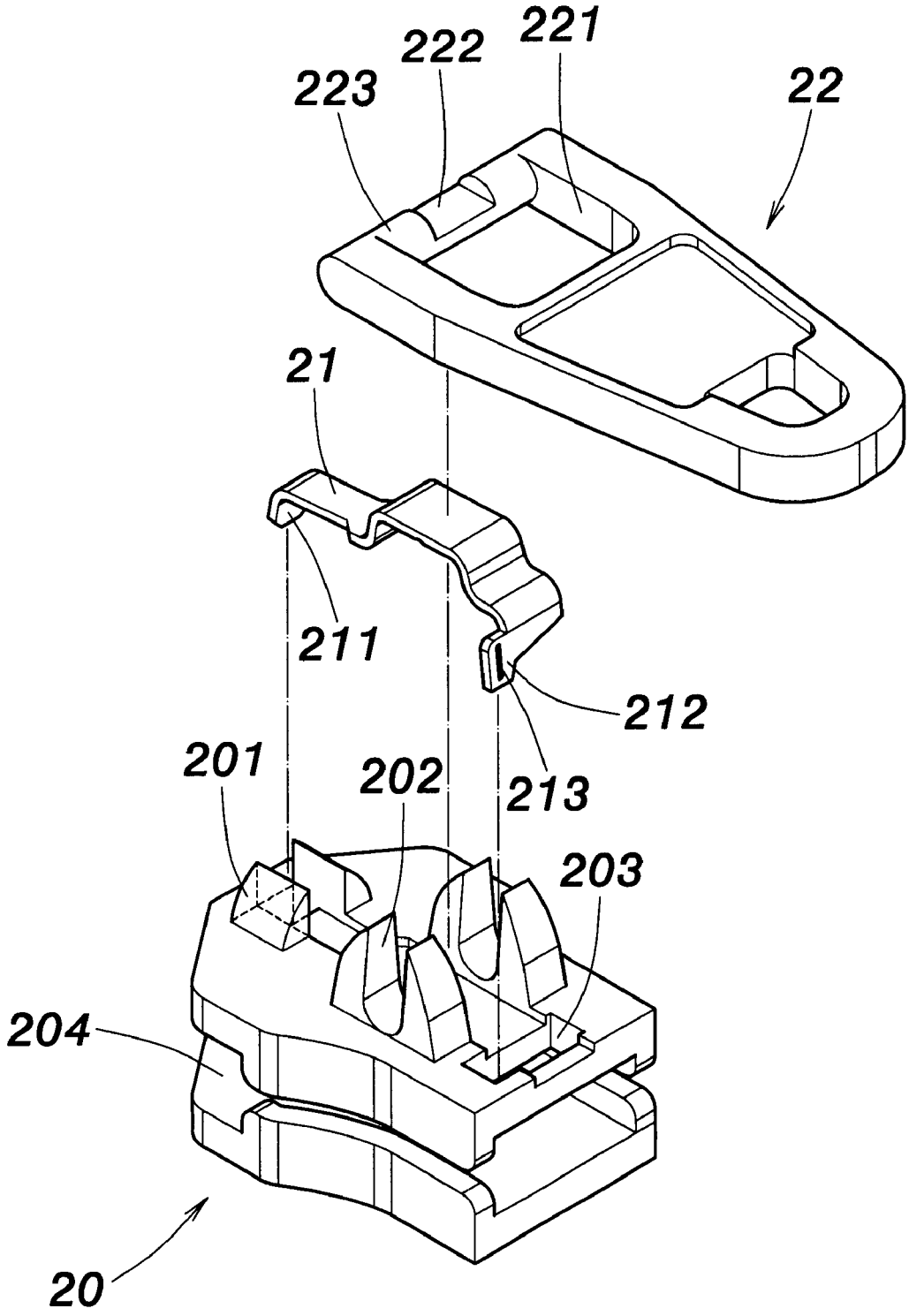
FIG. 4 is an exploded diagram illustrating this invention.
Figure 5:
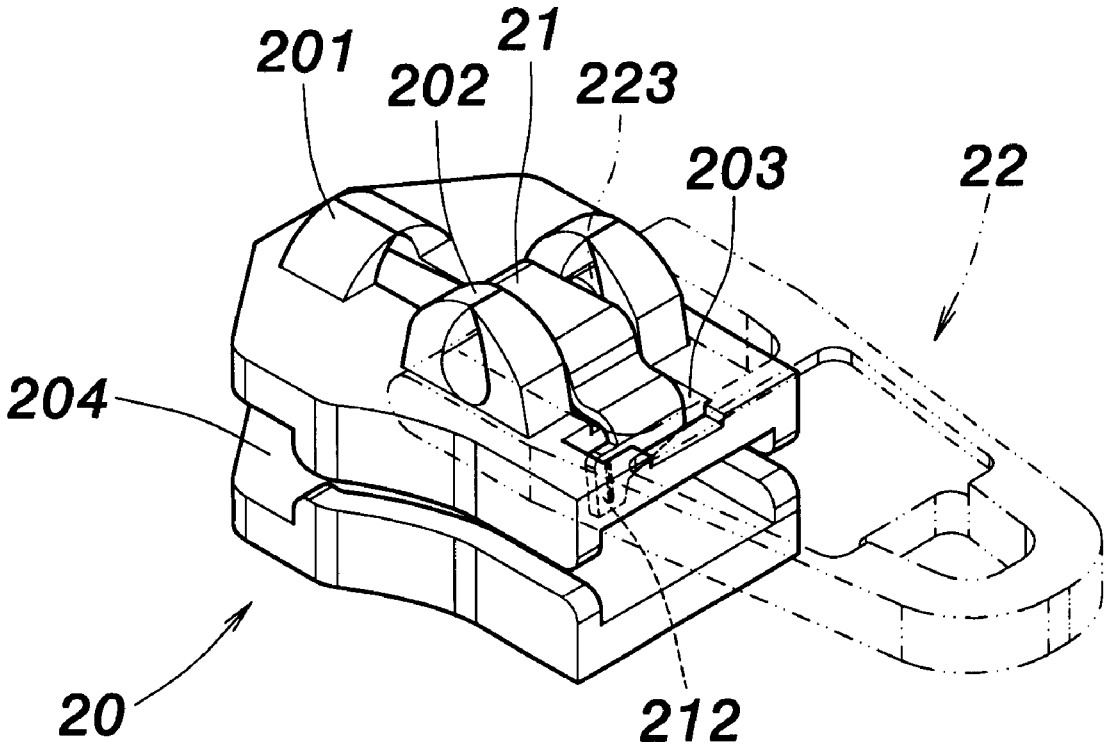
FIG. 5 is a perspective diagram showing this invention in combination.

Please refer to FIG. 4 and FIG. 5. This invention provides an improved needle locking structure for zipper slides. More particularly, this invention provides a means that is capable of enhancing interlocking the zipper teeth and is suited for either metal teeth or plastic teeth. This means of the invention generally comprises a monolithic main body 20, a spring piece 21, and a pull tab unit 22.

The main body 20, the spring piece 21, and the pull tab unit 22 may be made of aluminum alloys, zinc alloys or the like. Various colors of paint may be coated onto the surfaces of the main body 20, the spring piece 21, or the pull tab unit 22 by means of coating dye or bake coating.

Figure 6:
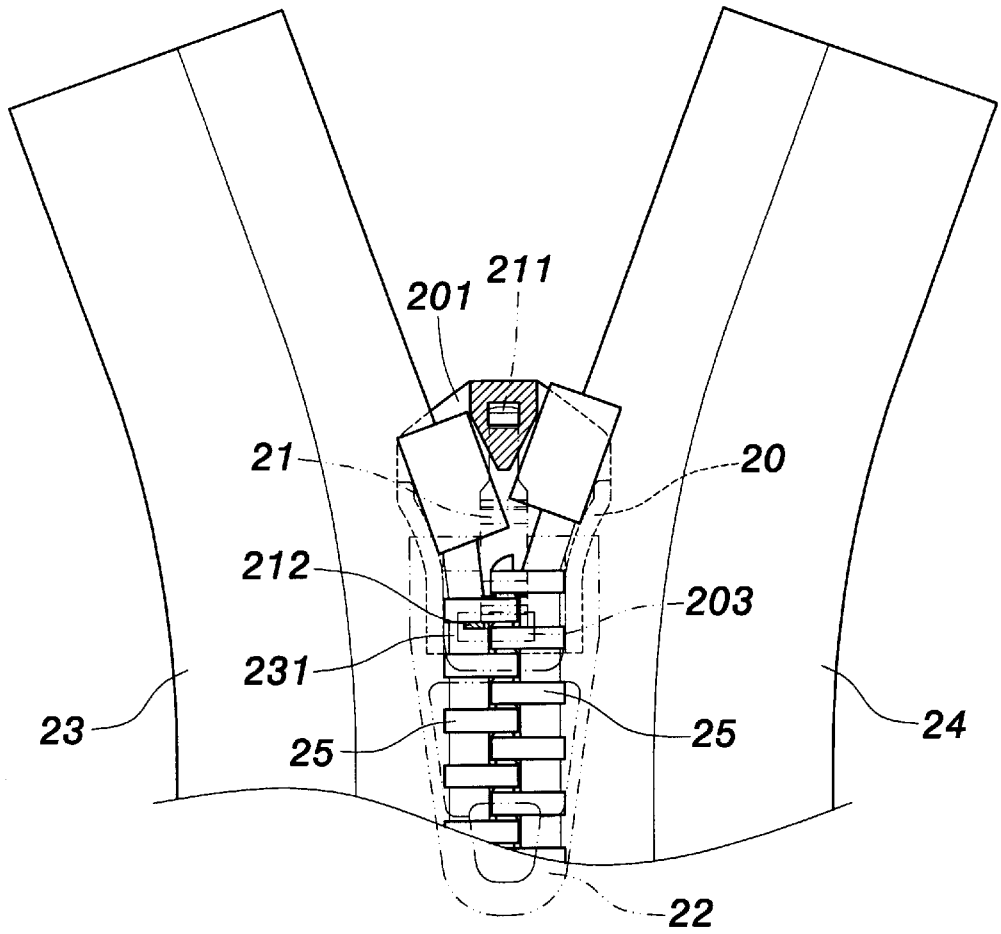
FIG. 6 is a schematic diagram illustrating the use of this invention.

Likewise, on a top surface of the main body 20 there are provided a first joint portion 201 and a second joint portion 202. The first joint portion 201 and the second joint portion 202 are used to buckle the spring piece 21 and also the pull tab unit 22 in place. Engagement channel 204 is provided in a front end of the main body 20. As shown in FIG. 6, the engagement channel 204 slides along the lengths of interlocking teeth 25 of the teeth tapes 23 and 24 to facilitate the engagement and disengagement thereof.

Figure 7:
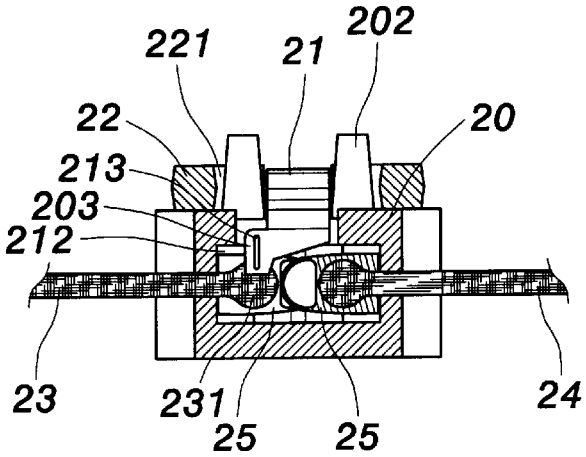
FIG. 7 is a cross sectional diagram showing this invention.

The spring piece 21 buckles the pull tab unit 22 by passing through opening 221 of the pull tab unit 22. As illustrated, the spring piece 21 has a hooked portion 211 in one end and a downwardly extending portion 212 formed in the other end. As shown in FIG. 7, the extending portion 212 is slightly shifted in a lateral direction such that the extending portion 212 is able to firmly lock the engagement line 231. When assembling, the hooked portion 211 is inserted into the front end of the main body 20, as shown in FIG. 6. The first joint portion 201 is then bent down so as to clip and fasten the spring piece 21. The extending portion 212 is inserted into a slot 203 located on the rear of the main body 20. In a preferred embodiment of this invention, a groove 213 for increase the mechanical strength of the extending portion 212 is provided as illustrated in FIG. 7.

Figure 8:
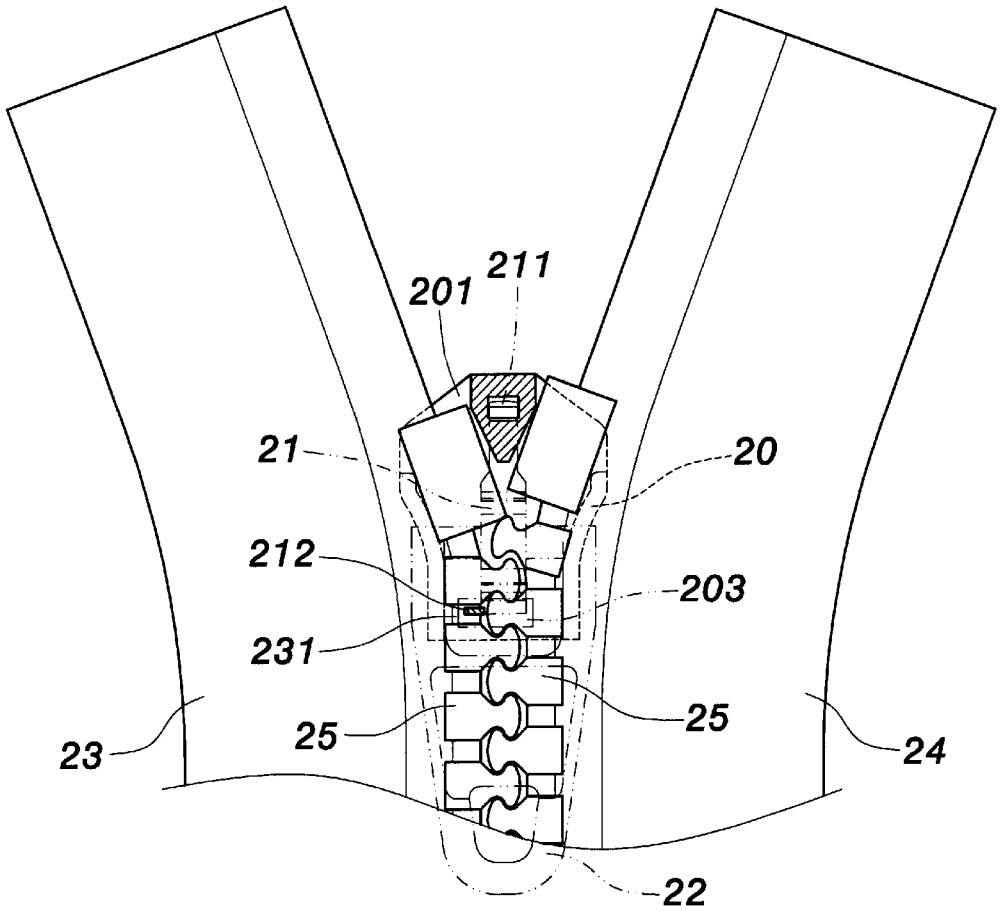
FIG. 8 is a schematic diagram illustrating the use of another embodiment according to this invention.
Figure 9:
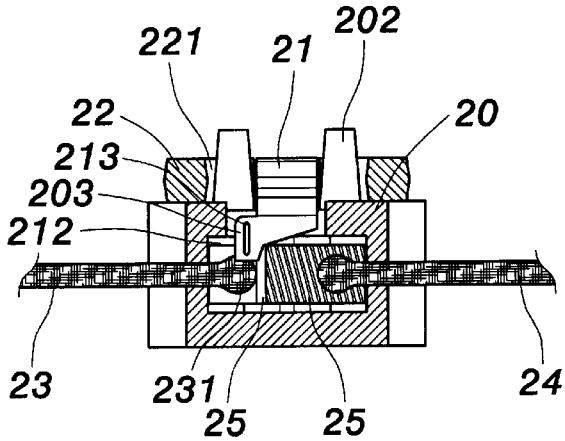
FIG. 9 is a cross sectional diagram of FIG. 8.

In FIG. 7, the laterally shifted extending portion 212 jabs the top of the engagement line 231 and thus increases the friction force whereby improving positioning of the main body 20 and preventing sliding of the main body 20. Further, since the friction force is increased, unwarily open of the zipper is prevented, as shown in FIG. 6 and FIG. 7. Moreover, as shown in FIG. 8 and FIG. 9, this invention is suited for plastic teeth that have larger inter-space between adjacent teeth.

Trademarks, totems or other patterns may be placed on the pull tab unit 22. The pull tab unit 22 facilitates manipulation of sliding the main body 20 to engage or disengage the metal teeth 25 of opposite teeth tapes 23 and 24.

The opening 221 is formed on the pull tab unit 22 and is designed to allow the passing of the spring piece 21. One side of the opening 221 is a beam 223 with a recess portion 222 thereon. The beam 223 is coupled with the second joint portion 202 and is restrained by the spring piece 21. The recess portion 222 is provided for positioning purpose for the spring piece 21. Typically, the width of the recess portion 222 is substantially equivalent to the width of the spring piece 21.

From above, the needle locking structure according to this invention at least includes the following features:

(1) The friction force of the engagement line 231 of the teeth tape 23 is increased due to the lateral shifted extending portion 212 of the spring piece 21 whereby preventing unwarily open of interlocking teeth of the zipper.

(2) This invention is suited either for metal teeth or plastic teeth.

(3) The groove 213 on the extending portion 212 enhances the mechanical strength of the extending portion 212.

Those skilled in the art will readily observe that numerous modification and alterations of the device may be made while retaining the teachings of the invention. Accordingly, the above disclosure should be construed as limited only by the metes and bounds of the appended claims.

What is claimed is:

1. A needle locking structure of a zipper slide for engaging or disengaging two lengths of teeth on two opposite teeth tapes, the needle locking structure comprising:

a monolithic main body having a first joint portion and a second joint portion formed thereon;

a spring piece disposed by the first joint portion and the second joint portion of the main body, and including an extension portion laterally shifted from an end thereof, wherein the extension portion includes a groove formed thereon;

a pull-tab unit fixed by the second joint portion of the main body for manipulation of the zipper slide;

wherein the extension portion jabs one of the teeth tapes, whereby friction is increased to improve the positioning of the main body and preventing inadvertent sliding of the zipper slide.

2. The needle locking structure of claim 1 wherein the main body, the spring piece, and the pull tab unit are made of metals and have various colors.

3. The needle locking structure of claim 1 wherein a hooked portion, which is inserted into the front of the main body, is provided at the other end of the spring piece.

4. A needle locking structure of a zipper slide for engaging or disengaging two lengths of teeth on two opposite teeth tapes, comprising:

a monolithic main body, two joint portions formed thereon, wherein an engagement part is formed on each side of the main body;

a spring piece fixed by the joint portions of the main body;

a pull-tab unit fixed by the second joint portion of the main body for facilitating the manipulation of pulling the zipper slide;

a laterally shifted extension portion provided at one end of the spring piece, a groove being provided on the extension portion;

wherein since the extension portion jabs the top of an engagement line of one of the teeth tapes, the friction force is increased for improving the positioning of the main body and preventing inadvertent sliding of the zipper slide.

5. The needle locking structure of claim 1 wherein the extension portion is suited for metal teeth or plastic teeth.

6. The needle locking structure of claim 1 wherein trademarks or totems may be placed on the pull tab unit.

7. The needle locking structure of claim 1 wherein the pull tab unit has a beam and a recess portion.

8. The needle locking structure of claim 7 wherein the recess portion is used to position the spring piece.

* * * * *